US009930912B2

(12) United States Patent
Bodenchuk et al.

(10) Patent No.: US 9,930,912 B2
(45) Date of Patent: Apr. 3, 2018

(54) PIPE LIGHTER HOLDER AND TOOL

(71) Applicant: Lifted Limited, LLC, Breckenridge, CO (US)

(72) Inventors: Matthew Robert Bodenchuk, Edwards, CO (US); Leslie Renea Reed, Edwards, CO (US)

(73) Assignee: Lifted Limited, LLC, Breckenridge, CO (US)

( * ) Notice: Subject to any disclaimer, the term of this patent is extended or adjusted under 35 U.S.C. 154(b) by 750 days.

(21) Appl. No.: 13/760,442

(22) Filed: Feb. 6, 2013

(65) Prior Publication Data

US 2013/0199548 A1 Aug. 8, 2013

Related U.S. Application Data

(60) Provisional application No. 61/595,532, filed on Feb. 6, 2012.

(51) Int. Cl.
*A24F 9/02* (2006.01)

(52) U.S. Cl.
CPC ..... *A24F 9/02* (2013.01)

(58) Field of Classification Search
CPC ..... A24F 9/02; A24F 9/04; A24F 9/10; A24F 3/02; A24F 23/04
See application file for complete search history.

(56) References Cited

U.S. PATENT DOCUMENTS

| | | | | | |
|---|---|---|---|---|---|
| 2,294,133 | A | * | 8/1942 | Schwalbe | 131/243 |
| 3,200,822 | A | | 8/1965 | Meyer | |
| 3,923,085 | A | * | 12/1975 | Nimer | B60N 3/12 131/247 |
| 4,043,348 | A | | 8/1977 | Kanady | |
| 4,152,109 | A | | 5/1979 | Schaffer | |
| 4,318,416 | A | * | 3/1982 | Thornhill | 131/243 |
| 4,600,022 | A | | 7/1986 | Pierce, Jr. | |
| D548,883 | S | | 8/2007 | Lin | |
| D662,655 | S | | 6/2012 | Bodenchuk et al. | |
| 2008/0142026 | A1 | | 6/2008 | Chou | |
| 2010/0065073 | A1 | | 3/2010 | Sweeney | |
| 2010/0101591 | A1 | | 4/2010 | Rosso | |

FOREIGN PATENT DOCUMENTS

| | | | | | |
|---|---|---|---|---|---|
| GB | 209416 | A | * | 7/1924 | A24F 9/04 |
| GB | 575451 | | * | 2/1946 | |

* cited by examiner

*Primary Examiner* — Eric Yaary
(74) *Attorney, Agent, or Firm* — Kilpatrick Townsend & Stockton LLP

(57) ABSTRACT

A standard smoking lighter slides into a hole on top of a plastic sheath so that only the top of the lighter is exposed. The bottom of the sheath has a hammer like protrusion at one end to stuff tobacco or other herb into a pipe. The opposite end of the bottom has a pivot point for a poker which serves to mix the herb and ash within the pipe and/or clean the debris from the pipe. The poker folds up into the sheath when not in use. Thus, a three function pipe tool provides a lighter, a stuffer and a poker.

6 Claims, 6 Drawing Sheets

PIPE LIGHTER HOLDER AND TOOL

CROSS-REFERENCE TO RELATED APPLICATIONS

This is a non-provisional application claiming the benefit of provisional application No. 61/595,532 filed Feb. 6, 2012 under 35 USC 119(e).

FIELD OF INVENTION

The present invention relates to a combination pipe/cigarette lighter holder, a pipe poker, used to clean the herb from the pipe and/or mix the herb and ash in the pipe, and a tobacco or an herb stuffer.

BACKGROUND OF THE INVENTION

Combination cigarette lighter holders and cigarette cases are well known in the art. Also known are lighter holders with pockets. Also known is a pipe lighter holder that actually forms a miniature pipe.

The traditional pipe smoker must use a lighter as well as a tobacco stuffer and a pipe poker to enjoy his pipe. What is needed in the art is a combination multi-tool and lighter holder.

The present invention provides a plastic case to hold a standard lighter. The case has a hammer shaped base on one side to serve as a tobacco or an herb stuffer. The other side of the base has a hinged poker to provide a metal rod to mix the tobacco or other herb and/or clean the pipe. When not in use the poker folds into the case.

SUMMARY OF THE INVENTION

The main aspect of the present invention is to provide a pocket sized sheath for a standard cigarette or smoking lighter, wherein the base of the sheath has a hammer like end and a folding poker end.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
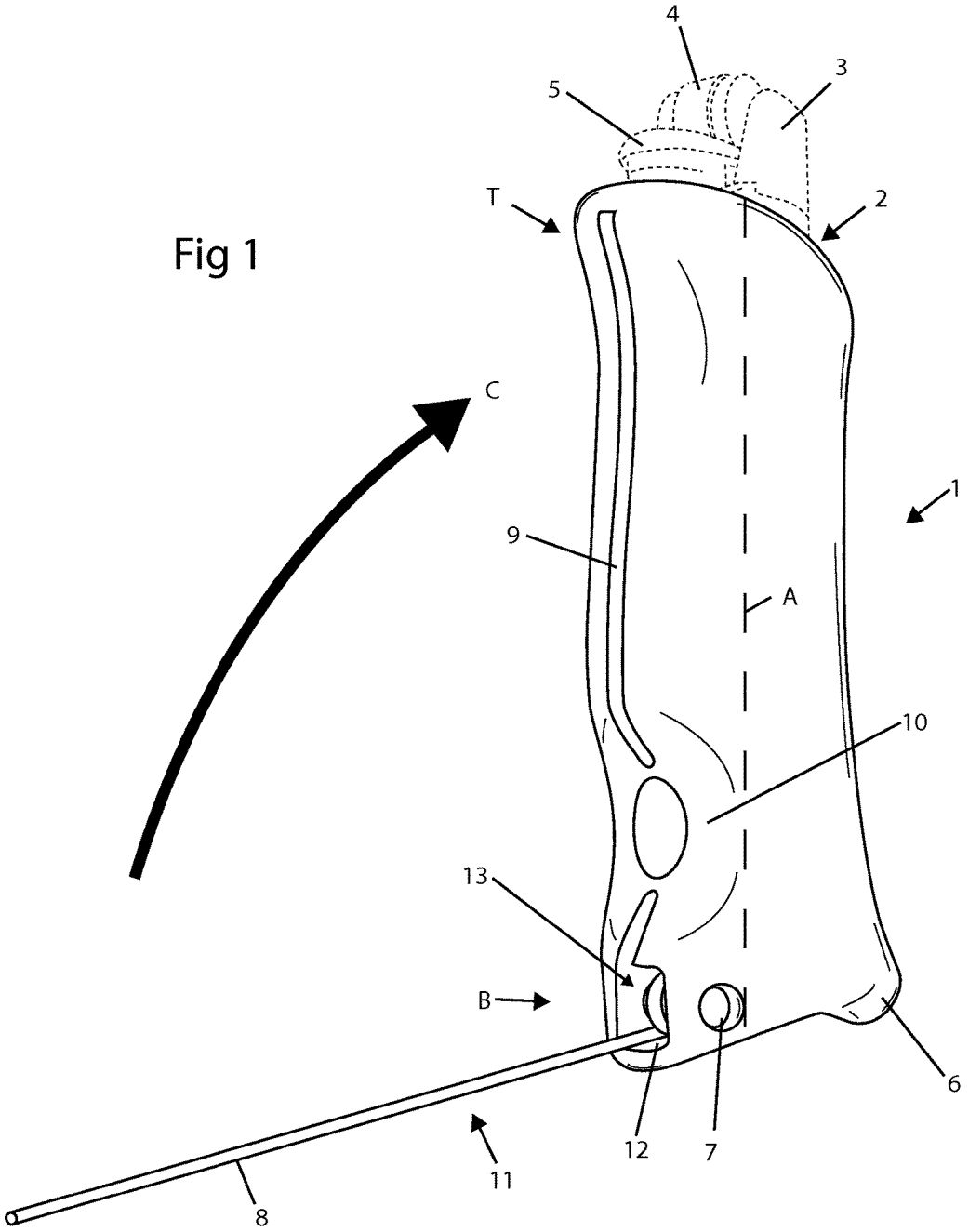
FIG. 1 is a top perspective view our lighter holder and tool showing a poker extended therefrom.

Referring first to FIG. 1, a pipe tool 1 is preferably made from a plastic mold. A central recess 2 at the top section T of the sheath of the pipe tool 1 is sized to hold a standard smoking lighter 3 such as a BIC® lighter. The lighter 3 has a thumb actuator 4 and gas release button 5, all standard in the art.

Figure 5:
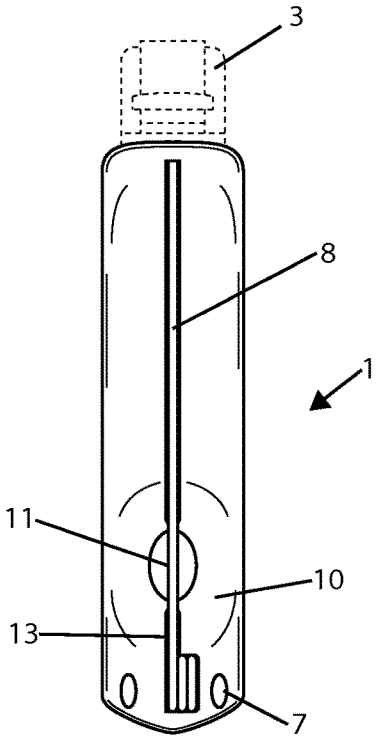
FIG. 5 is a front elevational view thereof.

The bottom section B of the sheath of the pipe tool 1 as shown has a protrusion 6 on a first side thereof which faces and extends down and out away from the central, longitudinal axis A of the sheath of the pipe tool 1 as well as downwardly away from the top section T of the sheath. Opposite the protrusion 6 on a second side of the bottom section B of the sheath as shown is a pivot at 7 which secures or mounts the base of a foldable poker 8. The poker 8 is preferably a metal rod. Poker 8 folds in direction C into longitudinal slot 9 in the second side of the sheath in the passive, closed position or mode of FIGS. 5 and 8. The longitudinal slot 9 as shown is open sided and faces or opens away from the first side of the sheath having the protrusion 6. As shown in FIG. 5, the elongated poker 8 in the closed position extends substantially parallel to the longitudinal axis A of FIG. 1 of the sheath. To move the poker 8 to the active, open position or mode shown in FIGS. 1, 6, and 7 with the elongated poker 8 extending substantially perpendicular to the longitudinal axis A, a recess 10 (FIGS. 1, 5, and 8) is provided. The recess 10 in this regard forms an opening under the poker 8 in the closed position of FIG. 8 between the sheath and the poker 8 to allow the user to pry up on section 11 (FIGS. 5 and 8) of the poker 8 and pivot the elongated poker 8 toward the open position thereof. This recess 10 in the second side of the sheath opposite the protrusion 6 on the first side of the sheath as shown extends substantially along and across the longitudinal axis (A) of FIG. 1 of the sheath. A ledge 12 (FIG. 1) at the bottom section B of the sheath stops the poker 8 at about a 90° angle to axis A. A hole 13 allows the poker 8 to pivot around the pivot at 7.

Figure 2:
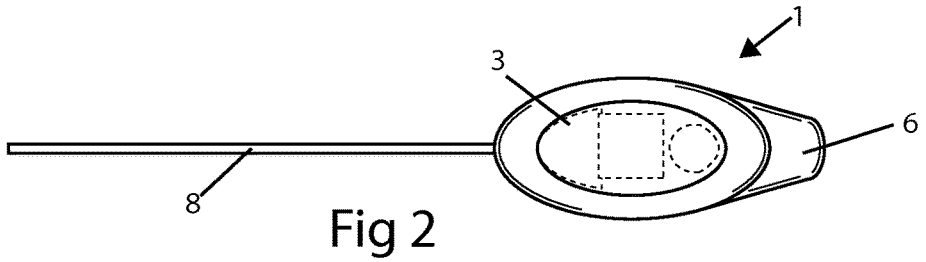
FIG. 2 is a top plan view thereof.
Figure 3:
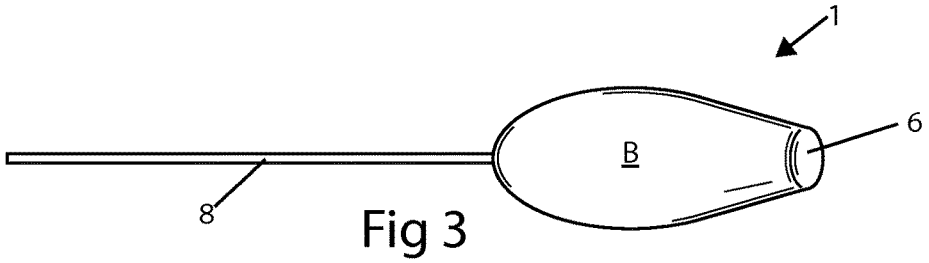
FIG. 3 is bottom plan view thereof.
Figure 4:
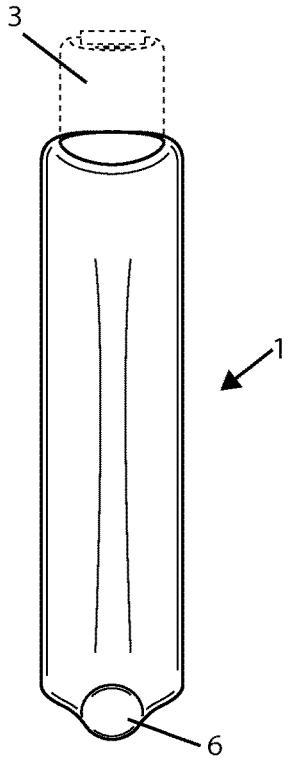
FIG. 4 is a rear elevational view thereof.

Referring next to FIGS. 2 and 3, the top and bottom views show the elongated poker 8 in the open position or active mode. FIG. 4 shows the protrusion 6 which is used as an herb tamper or stuffer when loading a pipe. FIG. 5 shows the closed position or passive mode of the elongated poker 8 in a front elevation view. The elongated poker 8 as shown in FIG. 5 has a cross-sectional width (see also FIGS. 1-3 and 6-8) and the open sided, longitudinal slot 9 receiving the poker 8 (see FIGS. 1 and 5) has a cross-sectional width substantially the same to closely and compactly receive the poker 8 therein in the closed position of FIGS. 5 and 8. Additionally as shown in FIG. 5, the longitudinal slot 9 in the sheath extends a first distance substantially along the longitudinal axis A of FIG. 1 of the sheath and the elongated poker 8 in the closed position thereof (FIG. 5) extends a second distance along the longitudinal axis A of the sheath substantially the same as the first distance. In this manner as shown in FIGS. 5 and 8, the elongated poker 8 in the closed position thereof is closely and compactly received in longitudinal slot 9.

Figure 6:
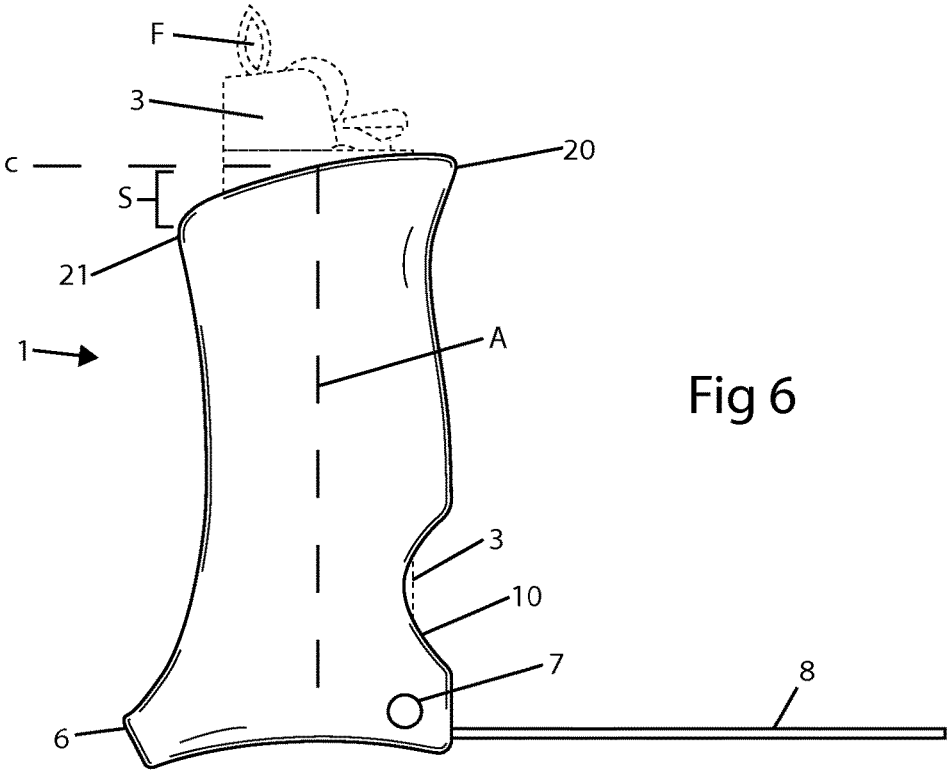
FIG. 6 is a right side elevational view thereof.
Figure 7:
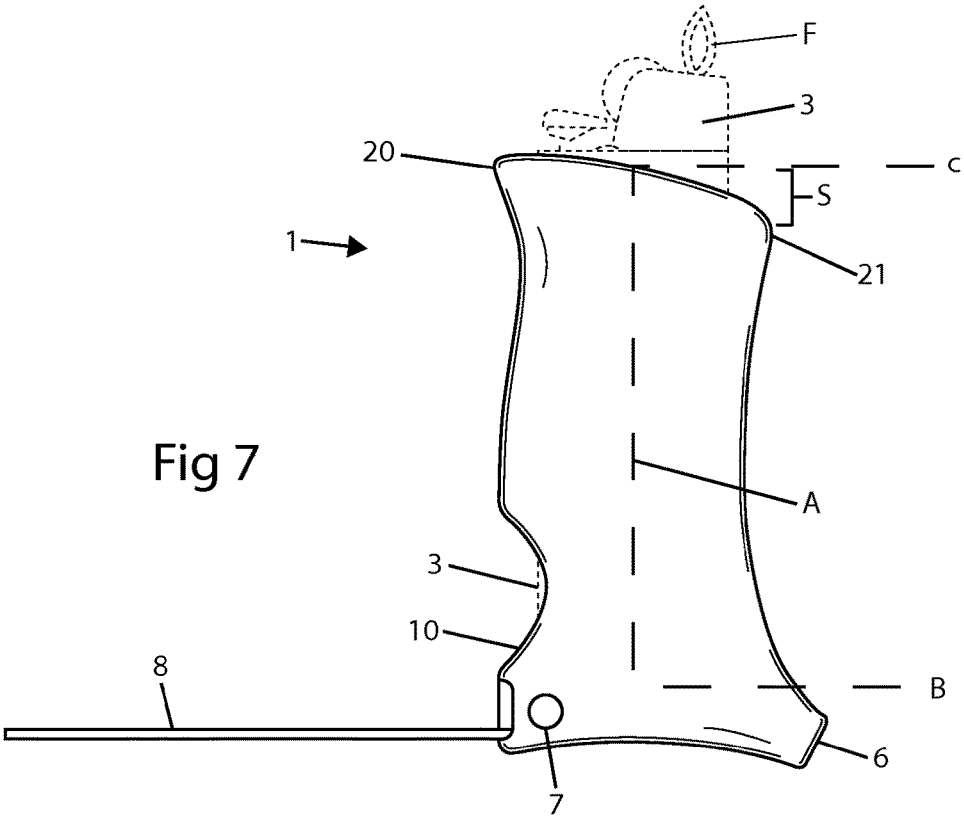
FIG. 7 is a left side elevational view thereof.

In FIGS. 6 and 7, the active mode or open position of the elongated poker 8 of the pipe tool 1 is shown. A horizontal line C is drawn at a 90° angle to axis A from the very top 20 of the pipe tool 1. A space S is formed between the line C and the lower top segment 21. This body shape increases the distance from the flame F to the top segment 21 which allows a wide range of tilt angles for the pipe tool to be used without burning the pipe tool 1.

Figure 8:
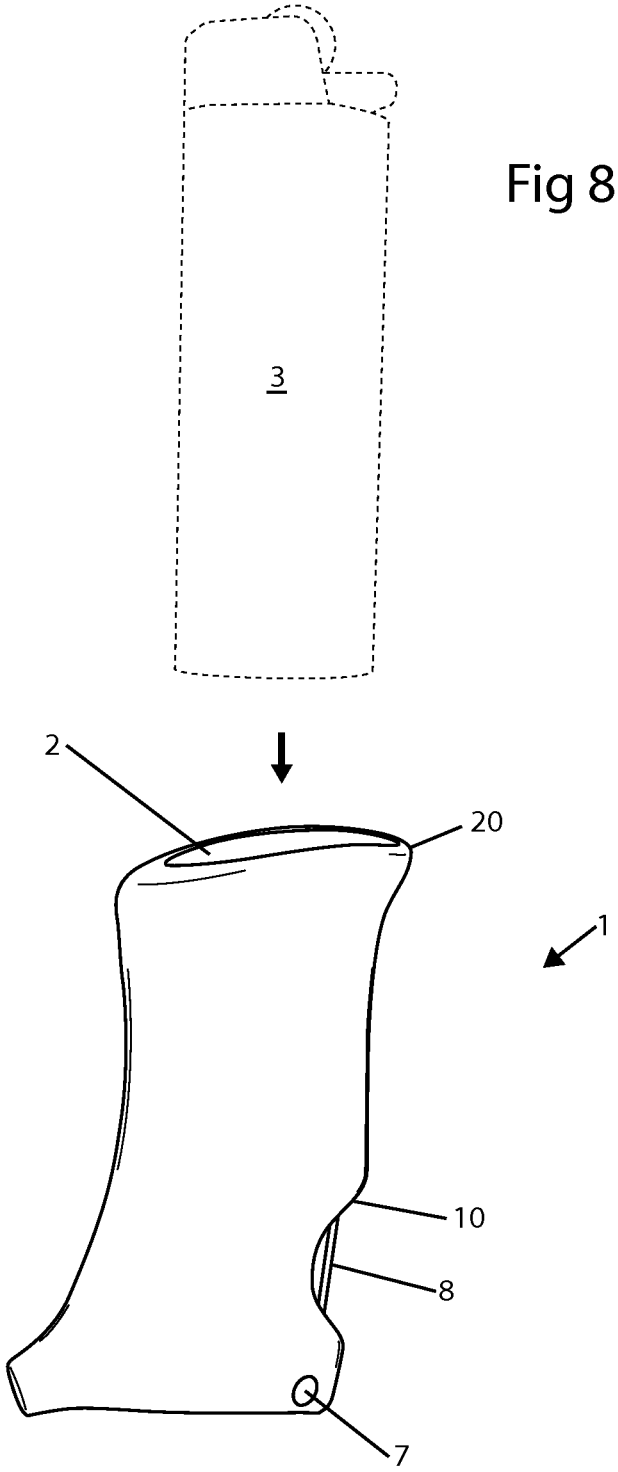
FIG. 8 is an exploded view of the invention.

In FIG. 8, the central recess 2 in the sheath of the pipe tool 1 is shown to be sized to firmly secure the lighter 3.

Figure 9:
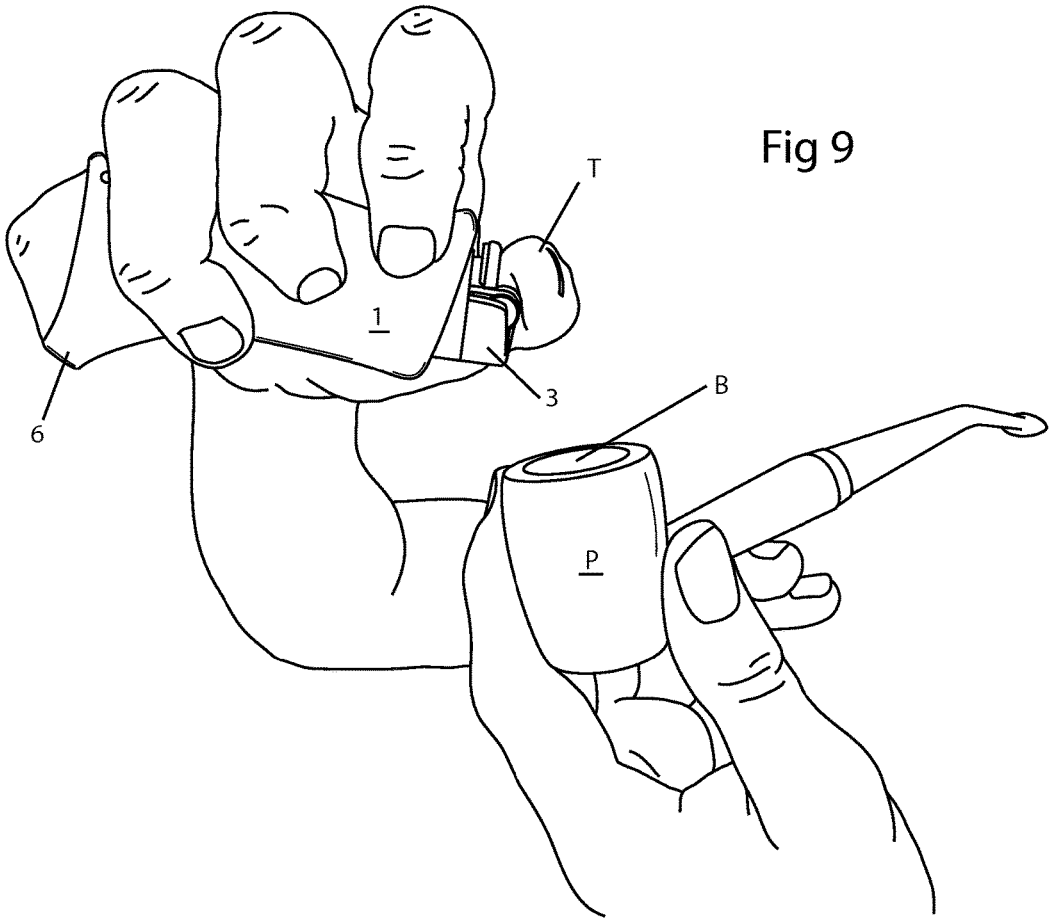
FIG. 9 is a front perspective view of the invention used as a lighter.

In FIG. 9, the user's thumb T is about to light the tobacco or other herb (not shown) in the bowl B of the pipe P.

Figure 10:
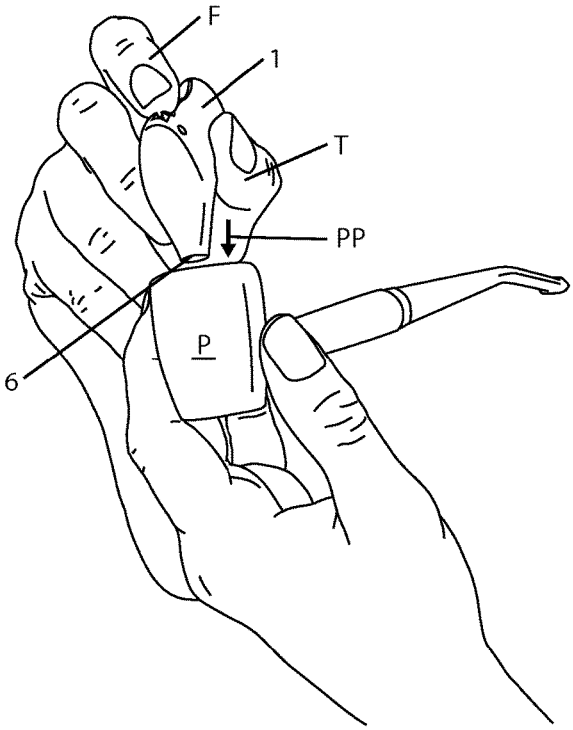
FIG. 10 is a side perspective view of the invention used as a stuffer.

In FIG. 10, the user's thumb T and index finger F use the end or protrusion 6 to stuff or tamp down the tobacco or other herb (not shown) in direction PP.

Figure 11:
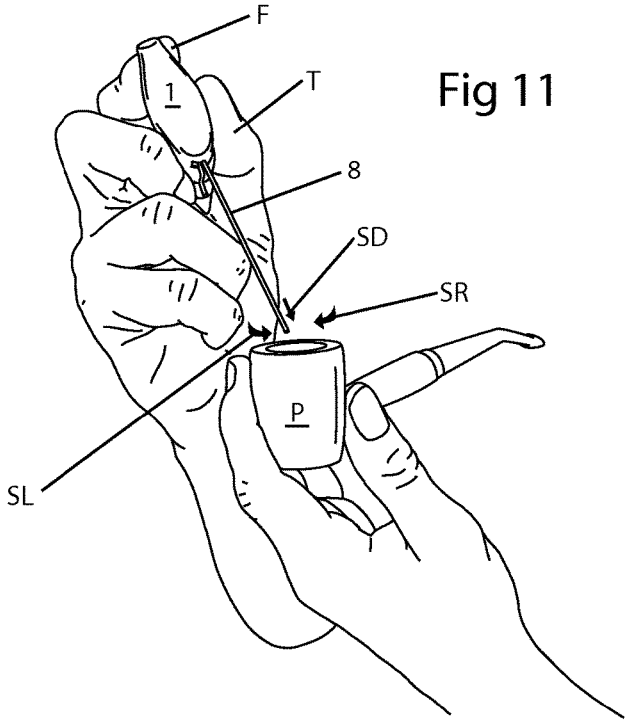
FIG. 11 is a front perspective view of the invention used as a poker.

In FIG. 11, the user's fingers, the thumb T and index finger F, support the pipe tool 1 so as to move the poker in directions down SD. left SL, and right SR. The poker 8 is in the open or active mode position.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A smoker's pipe tool (1) having:

a sheath extending along a longitudinal axis (A) between a top section (T) and a bottom section (B), said sheath having a central recess (2) extending along said longitudinal axis (A) sized to hold a smoking lighter (3), said bottom section (B) of said sheath having a protrusion (6) sized to function as a pipe bowl herb and ash tamper, an elongated, foldable poker (8) having first and second end portions with the second end portion mounted to the sheath for movement of the poker (8) about a pivot relative thereto between at least an open position extending substantially perpendicular to the longitudinal axis (A) of the sheath and a closed position extending substantially parallel to the longitudinal axis (A), said first end portion of said poker (8) being free standing in said open position of said poker (8) and insertable into the pipe bowl herb and ash with the second end portion thereof in the open position of said poker (8) spaced from the pipe bowl and the herb and ash therein, said sheath further including a longitudinal slot (9) extending along the longitudinal axis (A) of the sheath substantially between the bottom section (B) and top section (T) thereof, said longitudinal slot (9) being open sided and facing away from the sheath, said elongated poker (8) in said closed position extending substantially parallel to the longitudinal axis (A) and being substantially received in said elongated slot (9) wherein the elongated poker (8) has a cross-sectional width and the longitudinal slot receiving the elongated poker (8) has a cross-sectional width substantially the same to closely and compactly receive the elongated poker therein in said closed position.

2. The tool of claim 1 wherein the longitudinal slot extends a first distance substantially along the longitudinal axis of the sheath and the elongated poker in the closed position thereof extends a second distance along the longitudinal axis of the sheath substantially the same as said first distance.

3. The tool of claim 1 wherein the protrusion (6) extends outwardly of the longitudinal axis (A) on a first side of the sheath, the poker (8) is pivotally mounted to the bottom section (B) of the sheath on a second side opposite the first side of the sheath, and the longitudinal slot (9) extends along the second side of the sheath.

4. The tool of claim 3 wherein the sheath further includes a recess (10) in the second side extending substantially along and across the longitudinal axis (A) and under the poker in the closed position, thereby providing an opening under the poker between the sheath and the poker to facilitate prying and pivoting the poker from the closed position thereof substantially received in the longitudinal slot toward the open position thereof extending substantially perpendicular to the longitudinal axis (A) of the sheath.

5. The tool of claim 4 wherein the sheath further includes a ledge (12) outbound from the longitudinal axis (A) and the pivot to stop the poker at said open position extending substantially perpendicular to the longitudinal axis (A) of the sheath.

6. The tool of claim 3 wherein the protrusion (6) extending outwardly of the longitudinal axis (A) of the sheath also extends downwardly away from the longitudinal axis (A) and the top section (T) of the sheath.

* * * * *